US006575399B1

(12) United States Patent
Lamothe

(10) Patent No.: US 6,575,399 B1
(45) Date of Patent: Jun. 10, 2003

(54) WEB CONTROL MATRIX

(75) Inventor: Richard P. Lamothe, Burlington, CT (US)

(73) Assignee: Energy Savings Products and Sales Corp., Burlington, CT (US)

( * ) Notice: Subject to any disclaimer, the term of this patent is extended or adjusted under 35 U.S.C. 154(b) by 0 days.

(21) Appl. No.: 09/764,930

(22) Filed: Jan. 18, 2001

Related U.S. Application Data

(60) Provisional application No. 60/176,981, filed on Jan. 19, 2000.

(51) Int. Cl.[7] ..... B65H 23/32
(52) U.S. Cl. ..... 242/615.21; 226/196.1
(58) Field of Search ..... 242/615.21, 615.12; 226/196.1

(56) References Cited

U.S. PATENT DOCUMENTS 2,139,633 A * 11/1938 Hanson et al. ..... 242/615.21
3,285,446 A * 11/1966 Strickland ..... 242/615.21 X
3,337,107 A * 8/1967 Catallo et al. ..... 242/615.21
4,346,855 A * 8/1982 Biggar, III ..... 242/615.21 X
5,016,801 A * 5/1991 Gilat et al. ..... 242/615.21
5,108,022 A * 4/1992 Birkmair et al. ..... 242/615.21
5,174,096 A * 12/1992 Fukuda ..... 242/615.21 X
5,611,473 A * 3/1997 Reinhold et al. .... 226/196.1 X
5,823,464 A 10/1998 Bohn et al.
5,829,707 A 11/1998 Lamothe
6,027,003 A 2/2000 Gassner
6,047,922 A 4/2000 Michalik
6,050,191 A * 4/2000 Enderle et al. ..... 101/222
6,092,761 A 7/2000 Mushaben

* cited by examiner

*Primary Examiner*—Kathy Matecki
*Assistant Examiner*—Minh-Chau Pham
(74) *Attorney, Agent, or Firm*—McCormick, Paulding & Huber LLP

(57) ABSTRACT

A device for routing and redirecting a continuous web of sheet type material under tension, such as an endless roll of paper, from one processing or handling device to another, comprises a series of upright supports defining a polygon such as a square, and one or more generally horizontal tumbar members. When the web passes about a turnbar, the web's path is redirected in the vertical and/or horizontal planes toward the other web processing device.

8 Claims, 6 Drawing Sheets

WEB CONTROL MATRIX

CROSS REFERENCE TO RELATED APPLICATION

This application claims priority to provisional patent application Ser. No. 60/176,981, filed Jan. 19, 2000, and herein incorporated by reference.

FIELD OF THE INVENTION

This invention relates generally to apparatus that guide or redirect a continuous web of material, such as paper, fabric and the like. It relates more particularly to guiding and redirecting sheet type or web material between processing stations, such as a paper web under tension between printers and web winding machines, or other web processing machines such as cutters, slitters, mergers, or folders, for example.

BACKGROUND

The paper printing industry has undergone substantial changes over the past decade. Faster and more specialized equipment has allowed even moderately sized print shops to satisfy a wide variety of commercial printing needs. However, this equipment is almost always heavy, bulky, and very expensive. Rolls of paper weighing several hundred or even a thousand pounds are used by large commercial operations as a source of paper for their sizeable and numerous print jobs, with processing equipment positioned near or around the paper roll handling machines to minimize necessary movement of machinery. Tumbars have been employed to redirect a continuous paper web toward one machine or another, but have traditionally been mounted on the machines themselves. While alleviating some of the problems in moving and aligning heavy and sensitive equipment for high speed print runs, mounting turnbars on the associated equipment has been time consuming, has not alleviated the need for somewhat precise alignment of these heavy machines, and has not eliminated the need to physically move them from time to time to assemble differing printing process lines or for machinery maintenance.

What is needed in the art is an apparatus to reduce or eliminate the above shortfalls, one that would also allow reconfiguration of printing process lines by adding or omitting certain process machinery from the line without physically moving expensive and heavy equipment. The art has been recently enhanced by co-owned U.S. Pat. No. 5,860,616, wherein paper from alternate sources may be fed into a printer. The web control matrix disclosed herein is much more flexible and adaptable than the web feeding apparatus of the aforementioned patent, which is hereby incorporated by reference. The web control matrix of the present invention manipulates the path of web material among three axes so that machinery need not be moved to reconfigure a printing operation.

SUMMARY OF THE INVENTION

In accordance with the present invention, a matrix frame work is disclosed that provides a plurality of alternative paths for one or more paper webs to move from one web processing device to another web processing device, such as an unwind machine, printer, folder, and the like. The webs move under tension imposed by web tensioning means provided in at least one of the processing devices. The matrix framework comprises at least three uprights arranged in a polygon shape or pattern. Any two of the uprights can support at least one generally horizontally oriented turnbar, whereby the paper web under tension can be redirected by the horizontally oriented turnbar to provide a change in direction of the web.

BRIEF DESCRIPTION OF THE DRAWINGS

Applicant submits in this application the following drawings.

DETAILED DESCRIPTION OF THE PREFERRED EMBODIMENT

Figure 1:
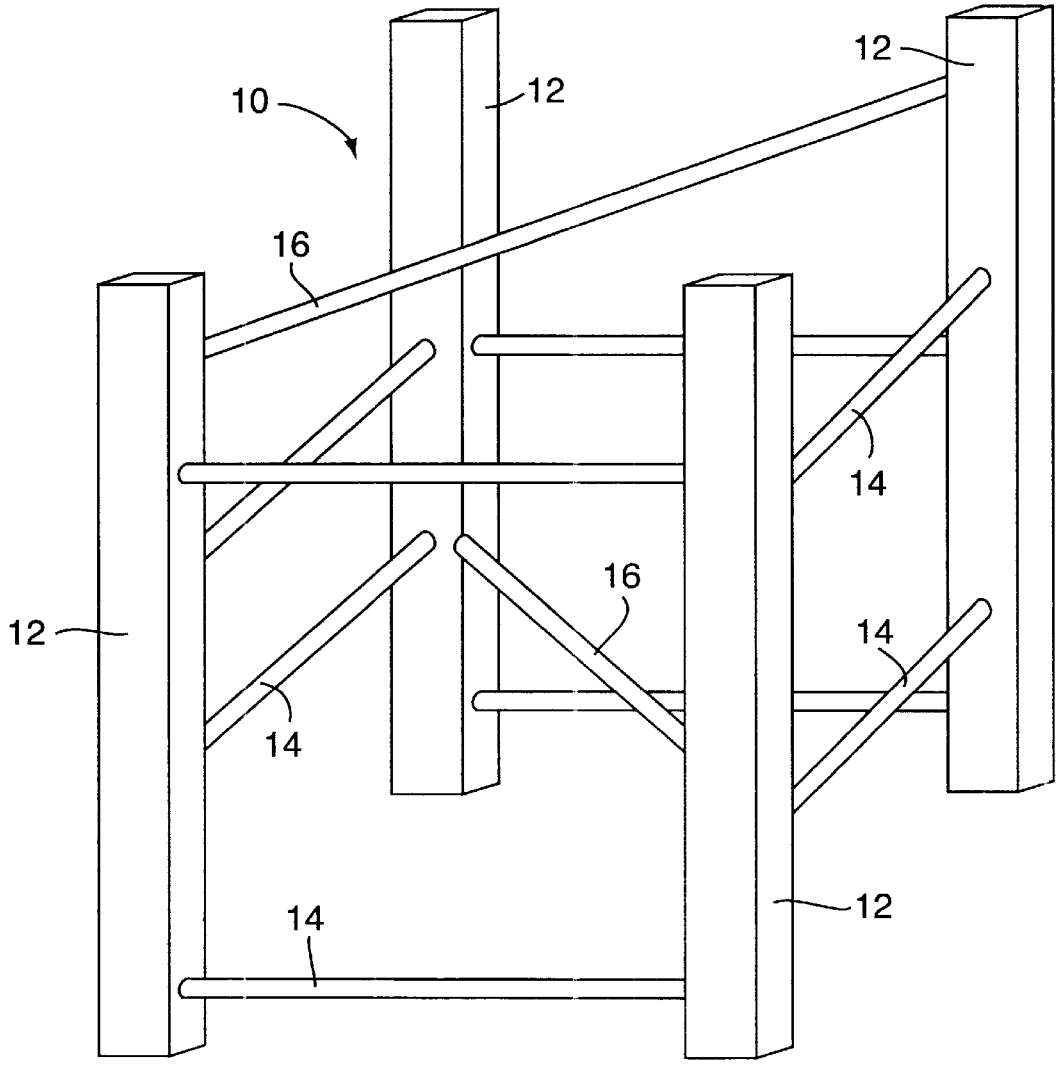
FIG. 1 is a perspective view of the preferred embodiment of the matrix of the present invention.

Turning now to the drawings in greater detail, FIG. 1 shows the web control matrix 10 comprising a series of upright supports 12 spanned by tumbars 14, 16 that lie in a generally horizontal plane. Turnbars that span adjacent upright supports are referred to hereinafter as straight turnbars 14. Turnbars that span non-adjacent upright supports are referred to hereinafter as diagonal tumbars 16. While the preferred embodiment of FIG. 1 indicates four upright supports defining the corners of a square when viewed from above, the invention is not so limited. A paper web 18 (shown in FIGS. 2 through 5) under tension is routed or threaded around one or more of these tumbars 14, 16 through the matrix 10 to redirect the paper web from its original path. Tension in the web is maintained by one or more paper procesing machines, or other tensioning means, independent of the matrix 10 itself. The advantages of such a matrix 10 are evident in the description of the following figures.

FIG. 1 shows the matrix frame schematically, and with turnbars 14 and 16 that are tied into the upright supports 12, 12 so as to provide a rigid framework even without any cross braces or even a base. However, it will be appreciated by those skilled in the art that with rotating tumbars some cross braces and at least a base for the uprights would be required, and also required would be means to rotatably support the tumbars. Such trunbar support bearings could also be adjustably mounted to the uprights without such a feature requiring any detailed description herein. Finally, the tumbars might also include an air cushion to reduce friction between the paper web and the turnbar. A hollow turnbar would communicate with a source of air under pressure so that selectively placed openings in the tubular turnbar could provide such an air cushion for the paper web.

FIGS. 2 through 5 indicate various paper web processing machinery by way of example to describe the operation and advantages of the matrix. FIGS. 2A and 2B illustrate how the matrix 10 of the present invention allows a single continuous paper web 16 to pass through it twice in the same process line, allowing machinery to be spatially oriented to optimize available floor space. These drawings show a block diagram wherein PRE refers to a pre-processing apparatus, such as an unwind machine 20 for unrolling virgin paper to be processed. Similarly, POST refers to post-processing apparatus, such as a rewind machine 22 for winding paper web 18, on which printing has been completed, back onto a roll. FIG. 2A shows the unwind 20 and rewind 22 machines aligned such that a paper web 18 may travel directly from one to the other in a straight line. With the matrix 10 inserted between them, a paper web 18 may be redirected 90° from its path out of the unwind machine 20 to exit out the side of the matrix 10 adjacent to the side by which it entered. This is accomplished by passing the web 18 about one of the diagonal turnbars 16. The paper web 18 may also pass about one or more of the straight turnbars 14 (shown in FIG. 1) to properly align it with the unwind machine and/or the desired diagonal turnbar. The paper web 18 exits the side of the matrix 10, and passes through a printer 24 which redirects the paper web back toward the matrix 10. The paper web 18 then re-enters the matrix 10 and passes about a different diagonal tumbar 16 which re-directs the web to exit toward the re-wind machine 22, also a 90° turn of the web. As before, straight turnbars may be employed to align the web in the proper horizontal plane for the desired diagonal turnbar and/or rewind machine.

Figure 2A:
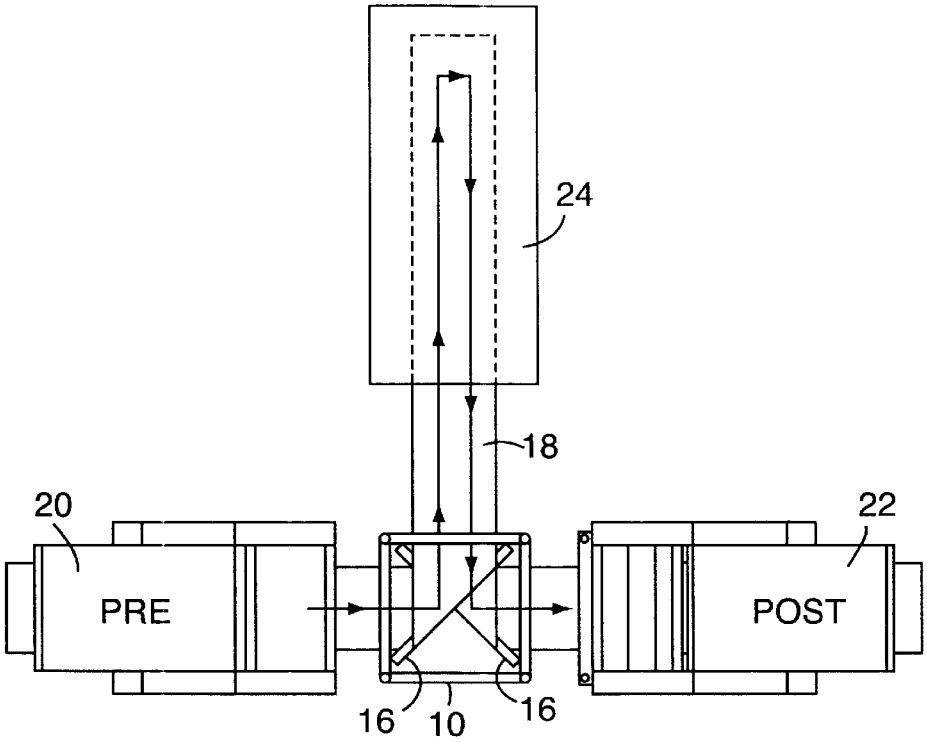
FIG. 2A is an overhead block view of the matrix of FIG. 1 imposed between three other paper processing devices.
Figure 2B:
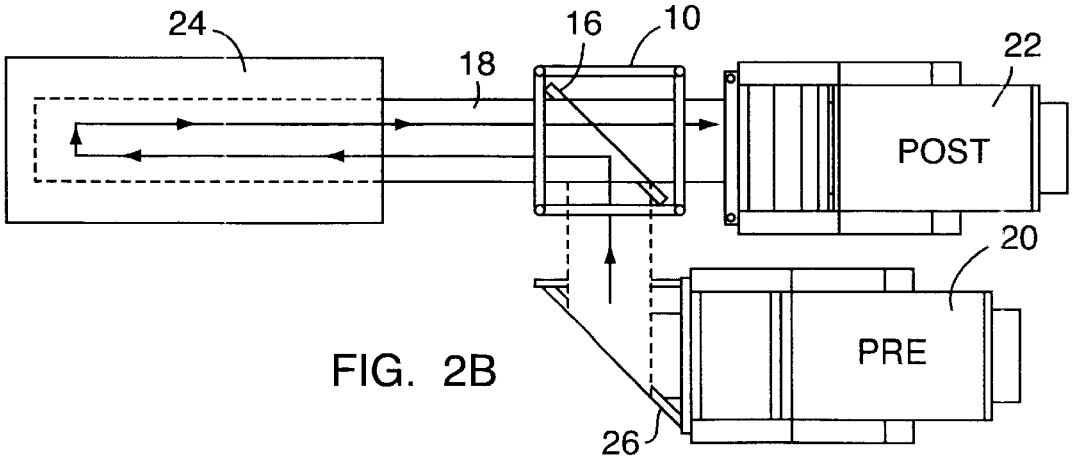
FIG. 2B is an overhead block view similar to FIG. 2A but having a different floor layout of machinery.

FIG. 2B shows paper processing equipment identical to that of FIG. 2A but oriented in a more compact floor layout. The unwind 20 and rewind 22 machines are side-by-side and the printer 24, matrix 10, and re-wind machine 22 are in a striaght line. A standard 45° turnbar 26 mounted on the unwind machine 20 directs the paper web 18 into the matrix 10. The web 18 passes about a diagonal tumbar 16 to redirect the web 18 toward the printer 24. The printer 24 prints on and redirects the paper web 18 back toward the matrix 10, which passes the web 18 toward the rewind machine 22. Each time the paper web 18 enters or exits the matrix 10, it may pass about straight turnbars to change the horizontal plane in which the paper web 18 lies.

Figure 3:
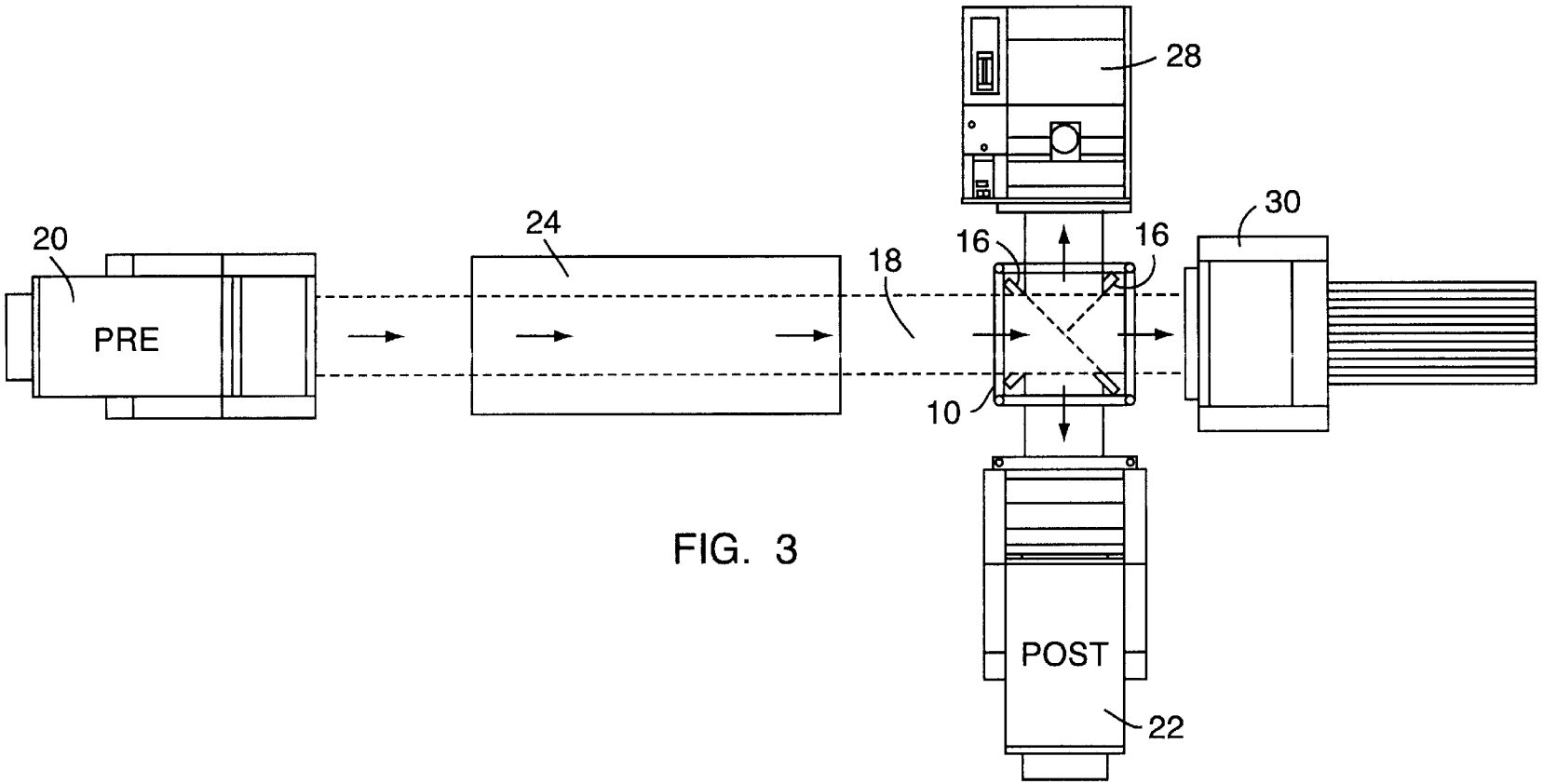
FIG. 3 is an overhead block view showing optimized layout of paper processing equipment by use of the matrix.

FIG. 3 shows how a paper web 18 from a single printer 24 may be redirected via the matrix 10 to either a rewind machine 22, a cutter 28, or a folder 30 without having to move any equipment. A paper web originating in an unwind machine 20 passes through a printer 24 and then enters one side of the matrix 10. Aligned with the remaining three sides of the matrix 10 are various post-processing machinery 22, 28 and 30. The post processing machine employed for a particular print job is selected merely by changing the path of the paper web 18 through the matrix 10. Diagonal turnbars 16 redirect the paper web 18 to exit either side of the matrix 10 at 90° from its entry path, and straight turnbars 14 (FIG. 1) pass the web 18 safely through the matrix 10 by changing its horizontal plane. Machinery need not be relocated to adapt to a different print job that requires different post processing machinery, and a wide variety of post processing machines can support a single printer without the inefficiencies of moving equipment to assemble a process line for the job at hand.

Figure 4A:
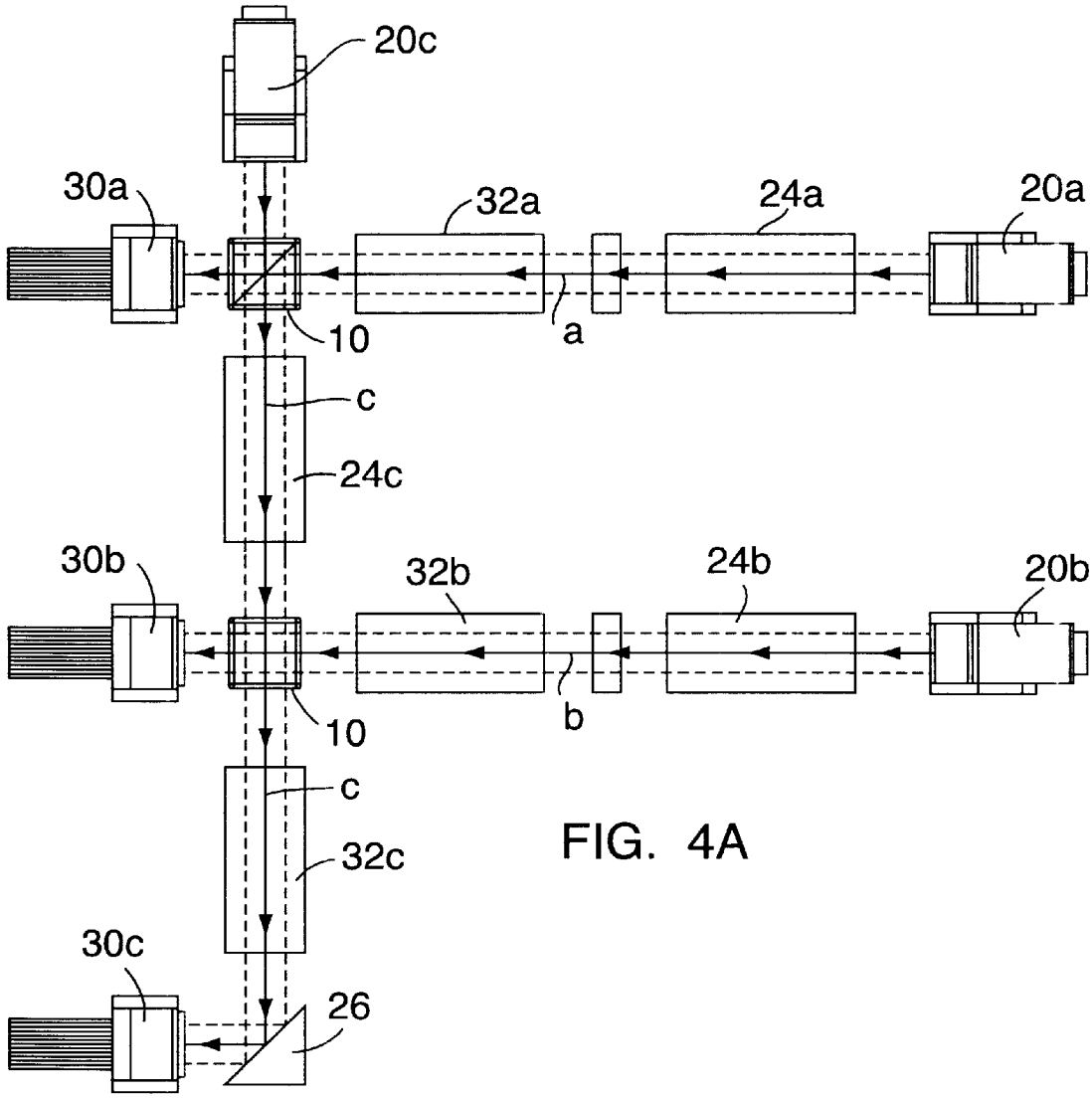
FIG. 4A shows three paper webs crossing paths at two matrices, and associated paper processing equipment.

FIG. 4A shows three sets of paper processing equipment comprising unwind machines (20*a,* 20*b,* 20*c*), a first printer (24*a,* 24*b,* 24*c*), a second printer (32*a,* 32*b,* 32*c*), and a folder (30*a,* 30*b,* 30*c*) for each wherein each lowercase letter a, b, c represents equipment in a single paper processing line. Two matrices 10 are imposed to each intersect two processing lines a and c or b and c, and a standard 45° tumbar 26 is placed near the end of processing line c. As displayed in FIG. 4A, when the paper webs cross paths through the matrices 10, each processing line a, b, and c passes through two printers prior to being folded. When the routing through the matrices is changed as in FIG. 4B, two processing lines are formed wherein each paper web passes through three printers (either 24*a,* 32*a,* and 24*c,* or 24*b,* 32*b,* and 32*c,* in order) prior to entering the folder 30*b* or 30*c*. Thus a more complicated print job may be run through the process lines defined in FIG. 4B without rearranging machinery from those process lines of FIG. 4A.

Figure 4B:
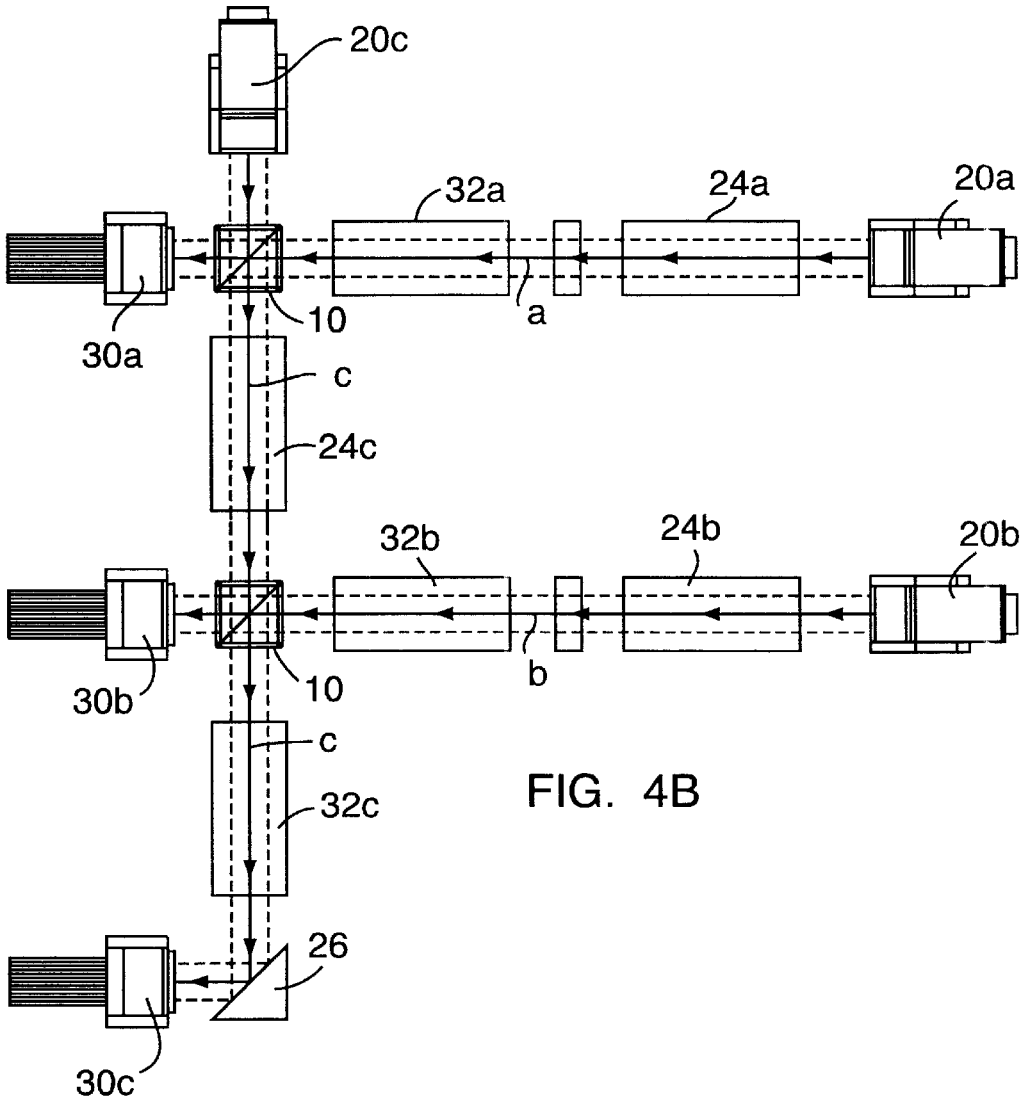
FIG. 4B shows an identical equipment layout of FIG. 4A except the matrices define two paper processing paths for more intricate print jobs.
Figure 5A:
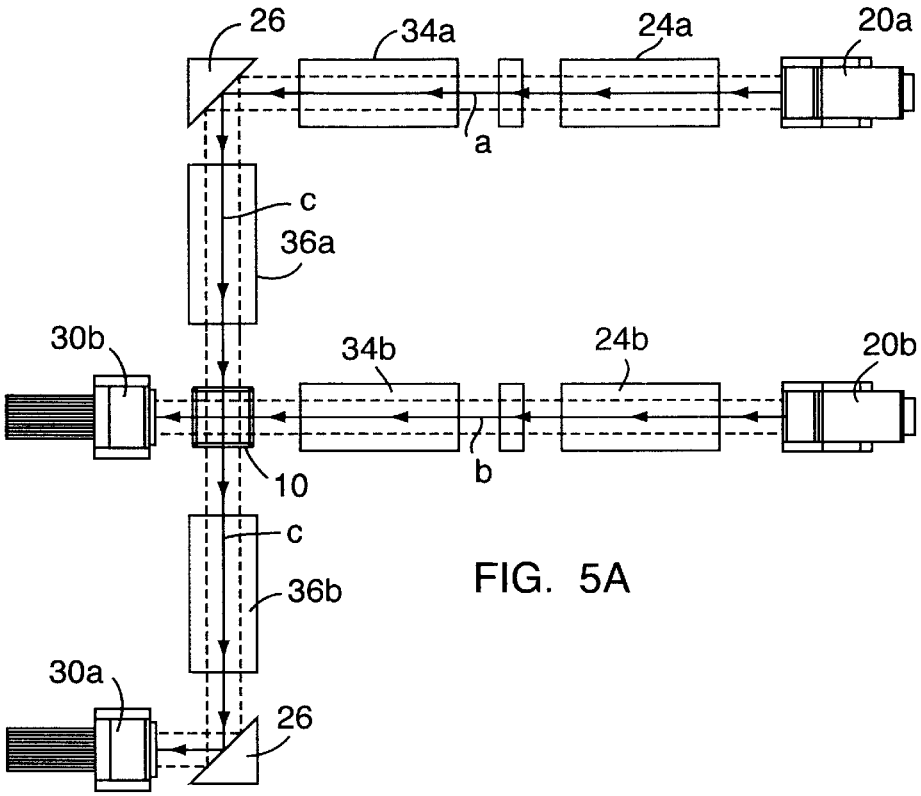
FIG. 5A shows two paper webs undergoing different processes based on their routing through the matrix.
Figure 5B:
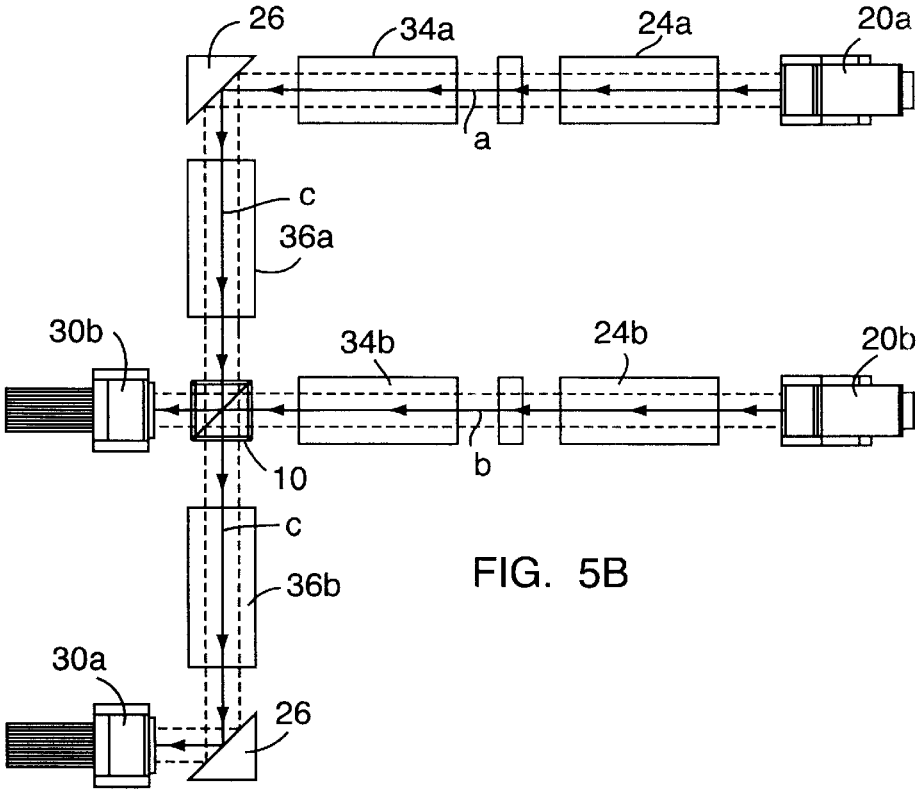
FIG. 5B shows the identical equipment of FIG. 5A but the webs undergo identical processes based on their routing through the matrix.

FIGS. 5A and 5B are conceptually similar to FIGS. 4A and 4B but show how two paper processing lines intersecting at one matrix 10 can define identical or different process lines without moving equipment. FIG. 5A depicts the paper webs following two different processing paths. One path passes from an unwind machine 20*a* through a printer 24*a,* a basic color machine 34*a,* and two enhanced color machines 36*a,* 36*b,* ending at a folder 30*a.* Two standard 45° turnbars 26 are also included in this processing path. The opposing path passes only from an unwind machine 20*b* through a printer 24*b* and a basic color machine 34*b,* ending at the folder 30*b.* Re-threading the paper webs 18 through the matrix 10 as in FIG. 5B makes the two processing paths identical, each passing from an unwind machine (20*a* or 20*b*) through a printer (24*a* or 24*b*), a basic color machine (34*a* or 34*b*), and an enhanced color machine (36*a* or 36*b*) before the folder (30*a* or 30*b*).

One or more matrices may also be used to add auxiliary processing machines to a printing operation, such as slitting, ink jet printing, label application, and the like, or to temporarily reroute paper web around a machine requiring repair, replacement, or inspection. The matrix may also be adapted such that multiple matrices may be stacked one on top of the other, expanding the vertical component so that paper may be fed from one floor of a building, printed on another, and returned elsewhere for packaging and shipping. It may also be adapted such that one or more external turn bars extend outside the matrix and redirects web into the matrix. This particular adaptation allows a web stream to be temporarily redirected while a single piece of equipment is removed from the process line, such as for inspection or repair, without the need to reposition the remaining operational equipment.

The turnbars of the web control matrix are readily adjusted so that the matrix is easily adaptable for varied applications. For example, a smaller print operation may employ the matrix for its space saving functions, allowing print related equipment to be placed within a minimal floor area. Alternatively, a larger print operation may employ the matrix for its ability to connect numerous pieces of equipment, allowing rapid changes between printers, unwind rolls, cutters, and the like. As is evident from the variety of examples above, the web control matrix is highly adaptable to many applications not enumerated above.

While the preferred embodiment has been shown and described, additional various modifications and substitutions will be apparent to those skilled in the art and may be made without departing from the spirit and scope of the present invention. The embodiment described above are hereby stipulated as illustrative rather than exhaustive.

I claim:

1. A matrix framework for providing alternative pathways for a paper web that moves from one web processing device to another device under tension comprising:

at least four upright supports, each defining a corner of a polygon;

a plurality of generally horizontal tumbars wherein at least one generally horizontal tumbar spans between each pair of adjacent upright supports; and at least one generally horizontal turnbar spanning between at least one pair of non-adjacent upright supports.

2. The matrix framework according to claim 1 wherein the polygon is a square.

3. A matrix framework for providing a plurality of alternative paths for a paper web that moves from one web processing device to another web processing device under tension imposed upon the web by web tensioning means provided in at least one of said processing devices, said matrix framework comprising:

a first upright support;

a second upright support spaced from the first upright support, and defining an opening for a first web path that passes between said first and second upright supports and is generally perpendicular to a plane defined by said first and second upright supports;

a third upright support spaced from the first and second upright supports;

a fourth upright support; and a first diagonal tumbar mounted to said first and third upright supports and oriented to enable a web that enters said matrix framework along said first web path to pass about the first diagonal turnbar and depart the matrix framework in a second direction along a second web path that is perpendicular to the plane.

4. The matrix framework of claim 3 further comprising a first lateral turnbar between the first and second upright supports.

5. The matrix framework of claim 3 further comprising a second lateral turnbar between the second and third upright supports.

6. The matrix framework of claim 3 further comprising a third lateral turnbar between the third and fourth upright supports.

7. The matrix framework of claim 3 further comprising a fourth lateral turnbar between the first and fourth upright supports.

8. The matrix framework of claim 3 further comprising a second diagonal turnbar perpendicular to the first diagonal turnbar and so oriented as to enable the web that enters the matrix framework along the first path to pass about the second diagonal turnbar and depart the matrix framework along the a third web path along a third direction that is opposite the second direction and perpendicular to the second web path.

* * * * *

UNITED STATES PATENT AND TRADEMARK OFFICE

CERTIFICATE OF CORRECTION

PATENT NO. : 6,575,399 B1
DATED : June 10, 2003
INVENTOR(S) : Richard P. Lamothe It is certified that error appears in the above-identified patent and that said Letters Patent is hereby corrected as shown below:

Title page,
Item [57], ABSTRACT,
Line 6, please delete “tumbar” insert -- turnbar --.

Column 1,
Line 31, after “machinery.”, please delete “Tumbars” insert -- Turnbars --, Column 2,
Line 34, after “by”, please delete “tumbars” insert -- turnbars --,
Line 38, after “diagonal”, please delete “tumbars” insert -- turnbars --,
Line 43, after “these”, please delete “tumbars” insert -- turnbars --,
Line 54, after “rotating”, please delete “tumbars” insert -- turnbars --,
Line 57, first word, please delete “tumbars” insert -- turnbars --,
Line 57, after “Such”, please delete “trunbar” insert -- turnbar --,
Line 59, after “the”, please delete “tumbars” insert -- turnbars --, Column 3,
Lines 25 and 36, after “diagonal”, please delete “tumbar” insert -- turnbar --, and Column 4,
Line 2, first word, please delete “tumbar” insert -- turnbar --.

Column 5,
Line 1, after “horizontal”, please delete “tumbars” insert -- turnbars --, and
Line 2, after “horizontal”, please delete “tumbar” insert -- turnbar --.
Line 23, after “diagonal”, please delete “tumbar” insert -- turnbar --.

Signed and Sealed this

Fourteenth Day of October, 2003

JAMES E. ROGAN
*Director of the United States Patent and Trademark Office*